United States Patent [19]

Romero

[11] 3,965,516

[45] June 29, 1976

[54] FOOTWEAR FABRICATION PROCESS

[76] Inventor: Juan Alvarez Romero, Fray Pedro Balaguer, 25, Elche (Alicante), Spain

[22] Filed: July 17, 1974

[21] Appl. No.: 489,396

[52] U.S. Cl. ..... 12/142 V; 12/142 RS; 36/3 B

[51] Int. Cl.[2] ..... A43D 9/00; A43B 7/06

[58] Field of Search ..... 12/142 R, 142 V, 142 S, 12/142 RS; 36/11.5, 3 R, 3 A, 3 B

[56] References Cited

UNITED STATES PATENTS

| | | | |
|---|---|---|---|
| 2,761,224 | 9/1956 | Gardiner | 36/11.5 |

FOREIGN PATENTS OR APPLICATIONS

| | | | |
|---|---|---|---|
| 1,059,901 | 3/1954 | France | 12/142 S |
| 2,084,234 | 11/1971 | France | 36/11.5 |

*Primary Examiner*—Patrick D. Lawson

*Attorney, Agent, or Firm*—Eyre, Mann, Lucas & Just

[57] ABSTRACT

A footwear fabrication process and product are disclosed. The footwear is characterized by flexibility, lightness and excellent ventilation.

3 Claims, 11 Drawing Figures

FOOTWEAR FABRICATION PROCESS

This procedure refers to a light-type footwear which is flexible and remarkably ventilated or transpirable.

In fact, the sole is of natural corded fibre so that the resulting cord is laid flat spiral-edged taking the pertinent shape of the sole of the foot according to established patterns thus ensuring its binding by means of a welt which cross-stitches the sole thus establishing shape and mutual positioning. On the lower side it also has rubber protection vulcanized direct on to the fibre itself by appropriate moulds.

The heel wedge which is higher or lower according to the designed use of the footwear, is fitted on this sole, the wedge being of the usual materials and covered at the side with natural fibre braid. This block and sole are held firmly together by suitable adhesive, forming a single piece.

Finally, the upper edges of the section are housed between the aforementioned single-piece sole and insole, the whole being glued together with adhesive.

A fully ventilated or transpirable and comfortable flexible shoe is obtained with such a process, different from other light-type shoes whose sole is of rigid moulded thermoplastic materials although in a subsequent operation they are covered with a fabric or else braided strip of natural or synthetic fibre material.

Better to interpret . . .

FIG. 1A is a cross sectional view of FIG. 1.

Figure 5:
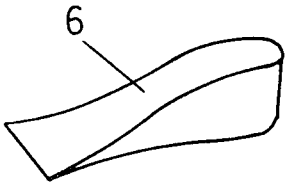
Figure 6:
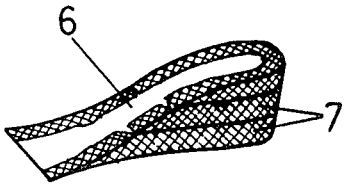

FIG. 5 & 6 pertain to the heel-block 1 and its outer lining with fibre braid or flagging similar to that of the sole.

Figure 7:
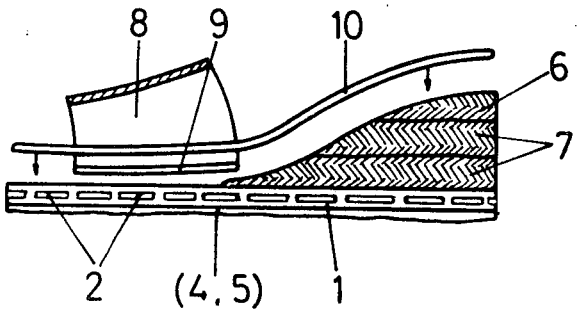
Figure 8:
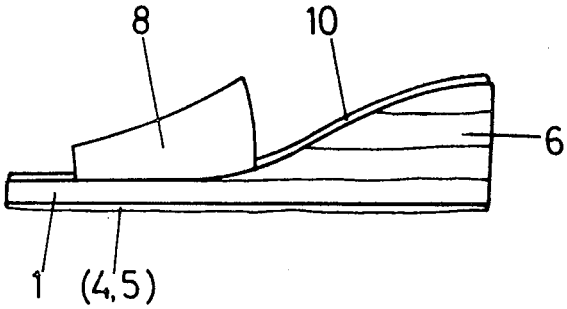

FIG. 7 shows welting of the section to the sole and arrangement of the insole, FIG. 8 depicting the finished footwear.

Figure 1:
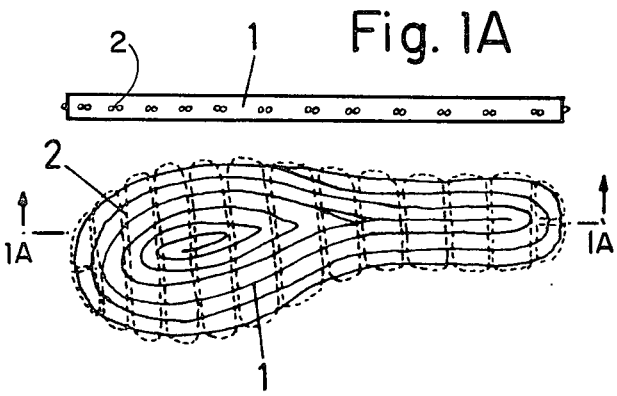
FIG. 1 is a floor view and matching longitudinal section of the sole shewing in broken lines the cross-positioning threads or cords for the spiral formed by the natural corded fibre.
Figure 2:
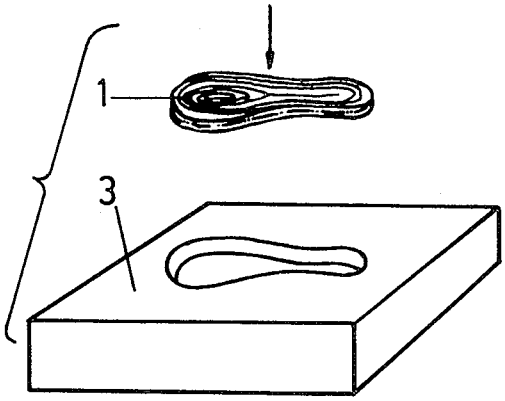
FIG. 2 is a fragmentary view depicting the rubber vulcanizing operation on the lower side of the sole, forming total or partial protection, as shown in FIG. 3 & 4.

The sole 1 — see FIG. 1, — is made of jute, hemp or similar natural fibre braided-cord. Its fastening is ensured by cross-stitching with thread or cord 2 of the same fibre.

Figure 3A:
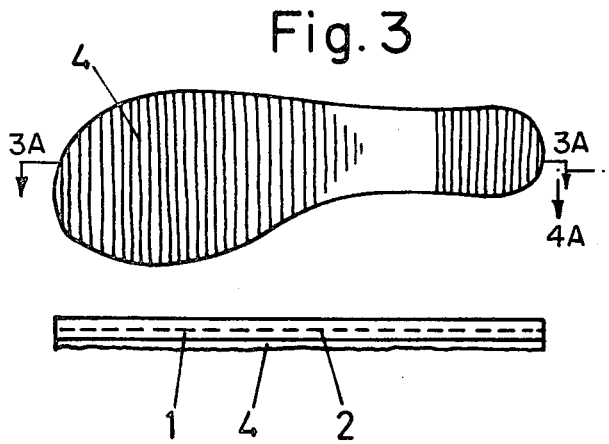
FIGS. 3A and 4A are cross sectional views of FIGS. 3 and 4 respectively.
Figure 4A:
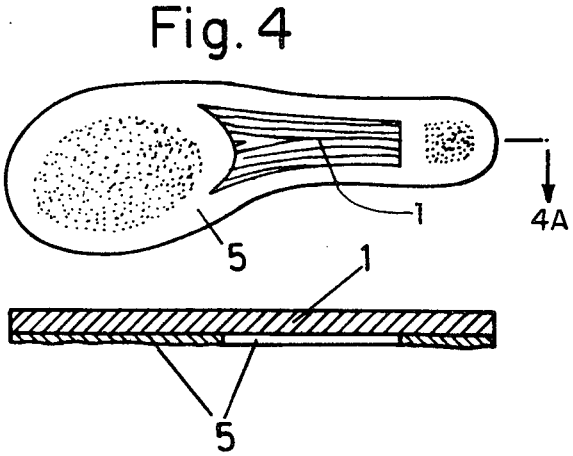

The underside of such a sole (in itself lacking in novelty and therefore not claimed) subsequently protected by direct vulcanization of rubber onto the fibre in suitable moulds 3. Such protection may be full 4 as noted in FIG. 3., or only partial 5 — see FIG. 4.

The heel-block 6 — see FIGS. 5 & 6 — is bonded to the sole in question, its height proportioned to the use to which the footwear so obtained will be put. This block 6 is side-lined with fibre braid or flagging 7 similar to that of the sole 1.

Finally, the lower edge-roll 9 of the section — see FIG. 7 — is interlaid between insole 10 and the sole 1 & 6 the whole bound by the use of appropriate adhesive and the finished shoe — see FIG. 8 — having a completely fibre sole remarkably ventilated and comfortable as a result.

I claim:

1. A process for fabrication of ventilated footwear of varying sizes comprising the steps of:

a. forming a spiral edged sole of predefined configuration and of cross-stitched dimension cord-like thread;

b. placing said sole in a rubber containing mold of predefined configuration and dimension corresponding to those of said sole;

c. setting said sole to achieve vulcanization of at least a portion thereof;

d. forming a heel having at least an outermost side portion of cross-stiched cord-like thread, and;

e. joining adhesively said sole and said heel.

2. The process of claim 1 and further comprising the steps of forming an overlaying member defining an inner sole and securing adhesively said overlaying member, said sole and said heel.

3. The process of claim 2 and further comprising the steps of forming a forward strap portion of predefined configuration and dimension appropriate to those of said sole and said heel and securing adhesively said strap intermediate said overlaying member and said sole contemporaneous with said step of securing said overlaying member to said sole and said heel.

* * * * *